US012538963B2

(12) United States Patent
Thompson et al.

(10) Patent No.: US 12,538,963 B2
(45) Date of Patent: Feb. 3, 2026

(54) SHOE UPPER, ESPECIALLY FOR A SPORTS SHOE

(71) Applicant: PUMA SE, Herzogenaurach (DE)

(72) Inventors: James Thompson, Nuremberg (DE); Lilly Cocks, Nuremberg (DE)

(73) Assignee: PUMA SE, Herzogenaurach (DE)

( * ) Notice: Subject to any disclaimer, the term of this patent is extended or adjusted under 35 U.S.C. 154(b) by 608 days.

(21) Appl. No.: 17/414,150

(22) PCT Filed: Dec. 19, 2018

(86) PCT No.: PCT/EP2018/086032
§ 371 (c)(1),
(2) Date: Dec. 21, 2021

(87) PCT Pub. No.: WO2020/125983
PCT Pub. Date: Jun. 25, 2020

(65) Prior Publication Data

US 2022/0304421 A1 Sep. 29, 2022

(51) Int. Cl.
*A43B 23/02* (2006.01)
*A43B 1/04* (2022.01)

(52) U.S. Cl.
CPC ..... *A43B 23/0245* (2013.01); *A43B 1/04* (2013.01)

(58) Field of Classification Search
CPC ..... A43B 1/04; A43B 23/025
See application file for complete search history.

(56) References Cited

U.S. PATENT DOCUMENTS

2014/0245638 A1* 9/2014 Seamarks ..... A43B 5/06 36/84
2014/0310987 A1* 10/2014 Sokolowski ..... D04B 1/24 36/84

(Continued)

FOREIGN PATENT DOCUMENTS

CN 104473376 A 4/2015
CN 108135317 A 6/2018

(Continued)

OTHER PUBLICATIONS

First Office Action from corresponding Chinese Patent Application No. 201880100386.X dated Jan. 7, 2022 (12 pages) (English translation included).

(Continued)

*Primary Examiner* — Khoa D Huynh
*Assistant Examiner* — Giao Q T Hoang
(74) *Attorney, Agent, or Firm* — Quarles & Brady LLP

(57) ABSTRACT

The invention relates to a shoe upper (1) for a shoe (2), especially for a sports shoe. To create an upper which allows an optimal lacing at a pleasant appearance the invention proposes that the upper comprises: a plane base layer (3) of material, a structured layer (4) being arranged on the outer surface (5) of the base layer (3) facing away from the foot of the wearer of the shoe (2), wherein the structured layer (4) comprises a plurality of tunnel sections (6), wherein each tunnel section (6) has at least one tunnel (7) which extends from a first side (8) to a second side (9) of the tunnel section (6) and wherein the tunnel section (6) comprises at least one connecting channel (10) which connects the tunnel (7) with the outer surface (11) of the tunnel section (6).

17 Claims, 6 Drawing Sheets

(56) References Cited

U.S. PATENT DOCUMENTS

| | | | | |
|---|---|---|---|---|
| 2016/0095388 | A1* | 4/2016 | Beye | A43B 23/0245 36/50.1 |
| 2018/0255876 | A1* | 9/2018 | Mcginnity | A43B 23/025 |
| 2018/0255877 | A1 | 9/2018 | Wilson | |

FOREIGN PATENT DOCUMENTS

| | | | | |
|---|---|---|---|---|
| FR | 2835405 | A | 8/2003 | |
| TW | 201600036 | A | 1/2016 | |
| WO | WO-2017067566 | A1 * | 4/2017 | A43B 13/141 |

OTHER PUBLICATIONS

International Search Report of International Application No. PCT/EP2018/086032, mailed Sep. 20, 2019, 3 pages.
Written Opinion of International Application No. PCT/EP2018/086032, mailed Sep. 20, 2019, 5 pages.
International Preliminary Report on Patentability (Form IPEA/409) of International Application No. PCT/EP2018/086032, mailed Jan. 27, 2020, 19 pages.

* cited by examiner

SHOE UPPER, ESPECIALLY FOR A SPORTS SHOE

This application is a U.S. National Stage application, filed pursuant to 35 U.S.C. § 371, of international application no. PCT/EP2018/86032, filed on Dec. 19, 2018, the contents of which is incorporated herein by reference in its entirety.

The invention relates to a shoe upper for a shoe, especially for a sports shoe.

Shoe uppers are well-known in the art. An example is disclosed in WO 2016/095938 A1. Here, the upper is made by a knitting process. Normally, the lace is threaded through openings which are machined into the upper. Consequently, the locations where the lace contacts the upper are defined and cannot be changed afterward.

Sometimes it is desired to create the possibility to modify or adjust the run of the lace along or through the upper.

Thus, it is an object of the present invention to create an upper for a shoe, especially for a sports shoe, which allows an optimal lacing, i. e. it should be possible to thread the lace into certain locations of the upper so that a desired lacing effect is obtained when the lace is fastened. Furthermore, the upper should have a pleasant appearance.

The solution of this object according to the invention is characterized in that the upper comprises:

- a plane base layer of material,
- a structured layer being arranged on the outer surface of the base layer facing away from the foot of the wearer of the shoe,
- wherein the structured layer comprises a plurality of tunnel sections, wherein each tunnel section has at least one tunnel which extends from a first side to a second side of the tunnel section and wherein the tunnel section comprises at least one connecting channel which connects the tunnel with the outer surface of the tunnel section.

The tunnels form preferably channels or tubes which run in a plane which is parallel to the surface area of the foot of the wearer. Also, the tunnels form preferably channels or tubes which run in a plane which is parallel to the plane of the flat or plane base layer.

It can be provided that exactly one connecting channel is arranged in each tunnel section. An alternative proposes that two connecting channels are arranged in each tunnel section arranged side by side.

Preferably, four adjacent tunnel sections enclose an area in which the base layer is free from covering tunnel sections; thus, the base layer can be seen when the shoe is regarded during intended use. The mentioned area has preferably an elongated shape. Here, an elliptical shape is preferred. Also a polygonal shape, especially a rectangular or a pentagonal or a hexagonal or an octagonal or a diamond-like or a honeycomb-like shape, is preferred.

The area has preferably a maximum length between 5.0 mm and 40.0 mm, especially between 10.0 mm and 35.0 mm.

A preferred embodiment of the invention provides that two adjacent tunnel sections are connected with another by a ridge; the ridge has preferably the same thickness than the tunnel sections.

The base layer has preferably a thickness between 0.5 and 4.0 mm. The tunnel section has preferably a thickness between 1.0 and 4.0 mm. The connecting channel has preferably a diameter between 1.0 and 3.0 mm.

It is specifically preferred that the base layer and the tunnel sections are made by a knitting process. The base layer and the tunnel sections form thereby preferably a unitary knit structure.

The base layer can be made from a first yarn, while the tunnel sections are made from at least one second yarn; the at least one second yarn is thereby different from the first yarn.

Furthermore, with respect to the used yarns it is preferred to use water resistant yarns, specifically polyester yarns. Specifically polyester yarn with a water resistant coating and a Nylon Bundy yarn mix is preferred. To create the water resistant yarn, the normal polyester yarn is immersed into a liquid water-repellent agent for a period of time until it is fully coated. The yarn is then dried and ready for use/knitting.

Below the described shoe upper additional material layers can be arranged, wherein those additional layers face the foot of the wearer.

By the proposed design of the shoe upper it becomes possible, to thread a lace through the mentioned tunnels at locations which can be individually selected so that the lacing effect is optimized according to the specific desires of the wearer of the shoe.

Furthermore, due to the proposed design of the structure a very pleasant appearance of the shoe is given. Specifically, the appearance of the shoe is not disturbed by the mentioned functionality of the shoe.

In the drawings embodiments of the invention are shown.

Figure 1:
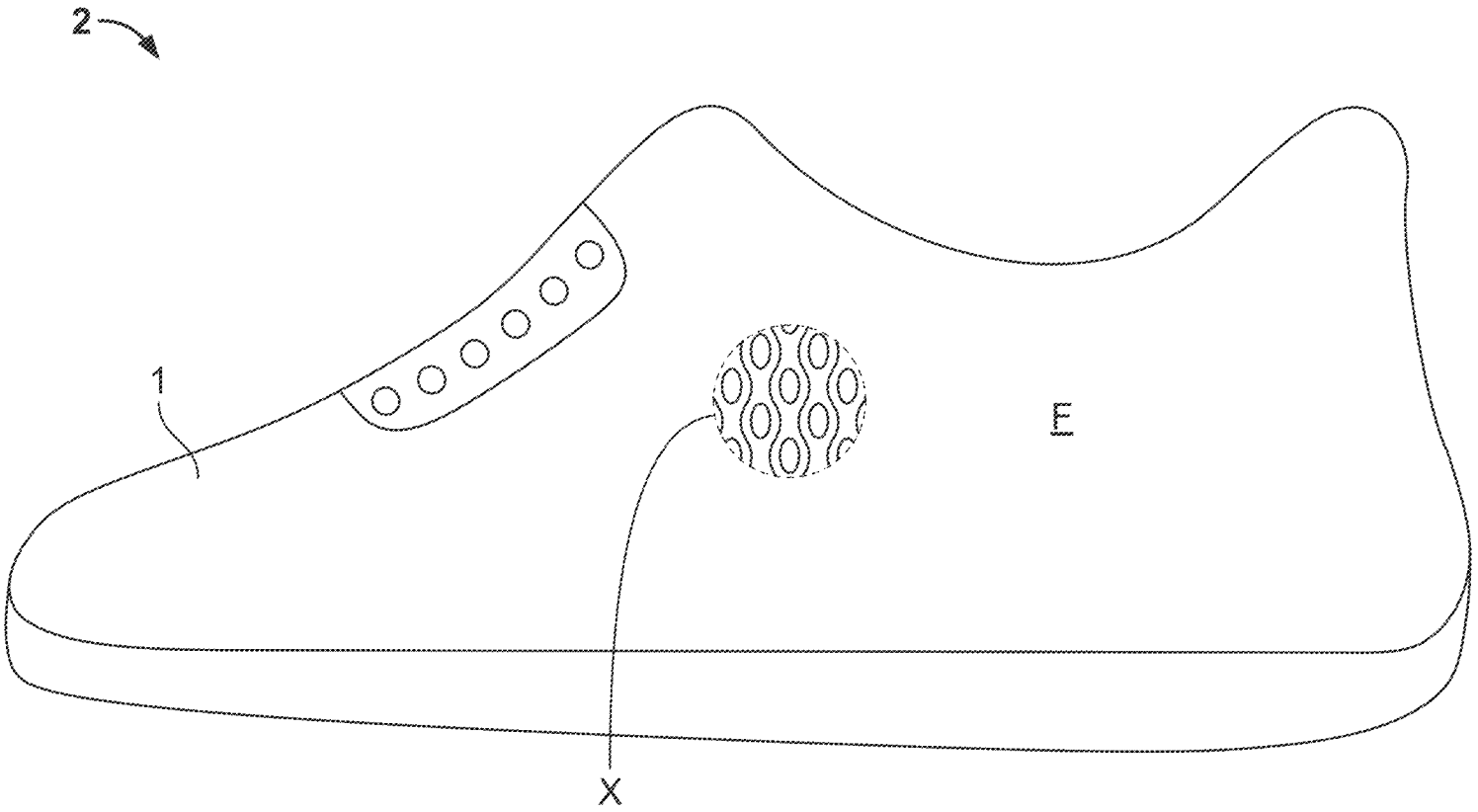
FIG. 1 shows schematically the side view of a sports shoe.
Figure 2:
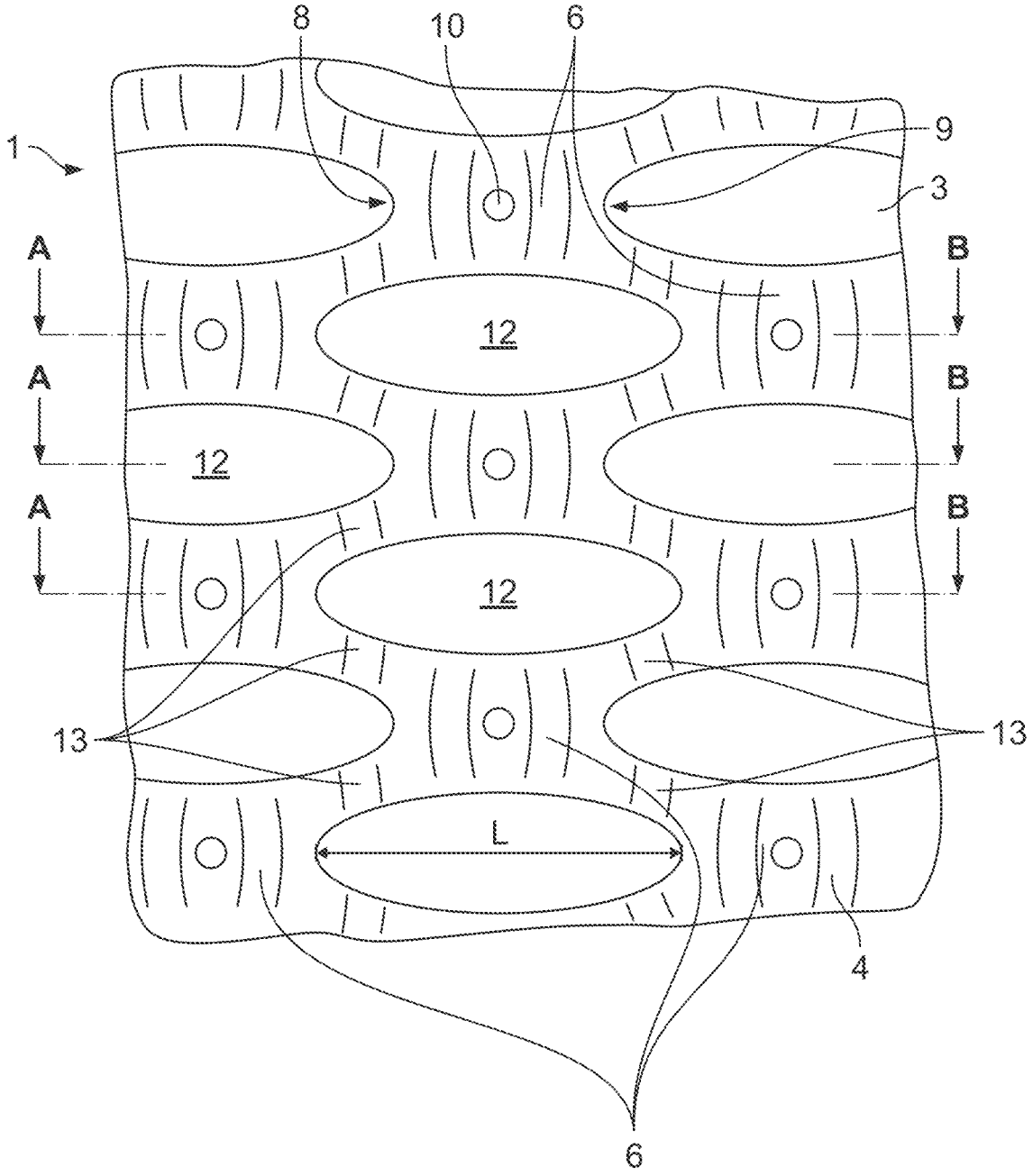
FIG. 2 shows the detail "X" according to FIG. 1.
Figure 4:
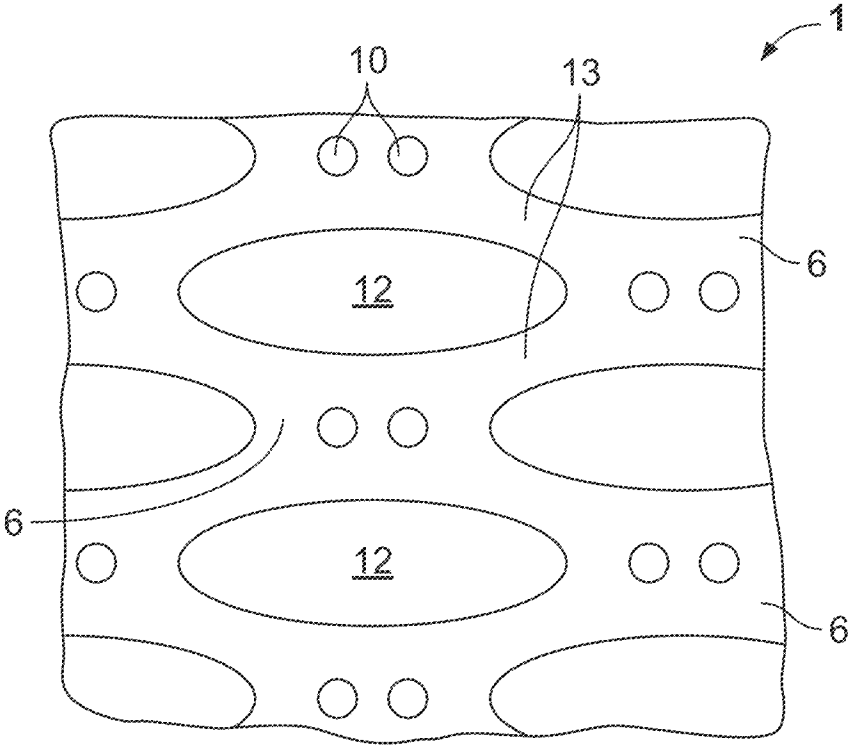
Figure 5:
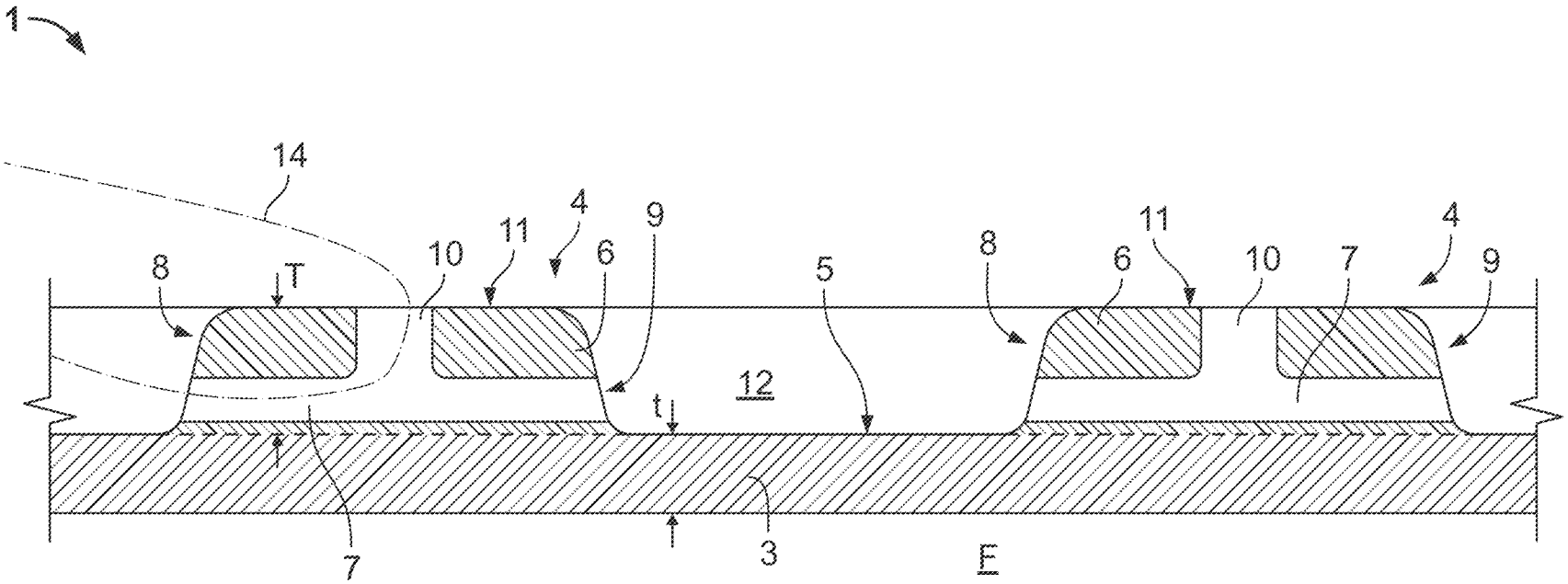
Figure 6:
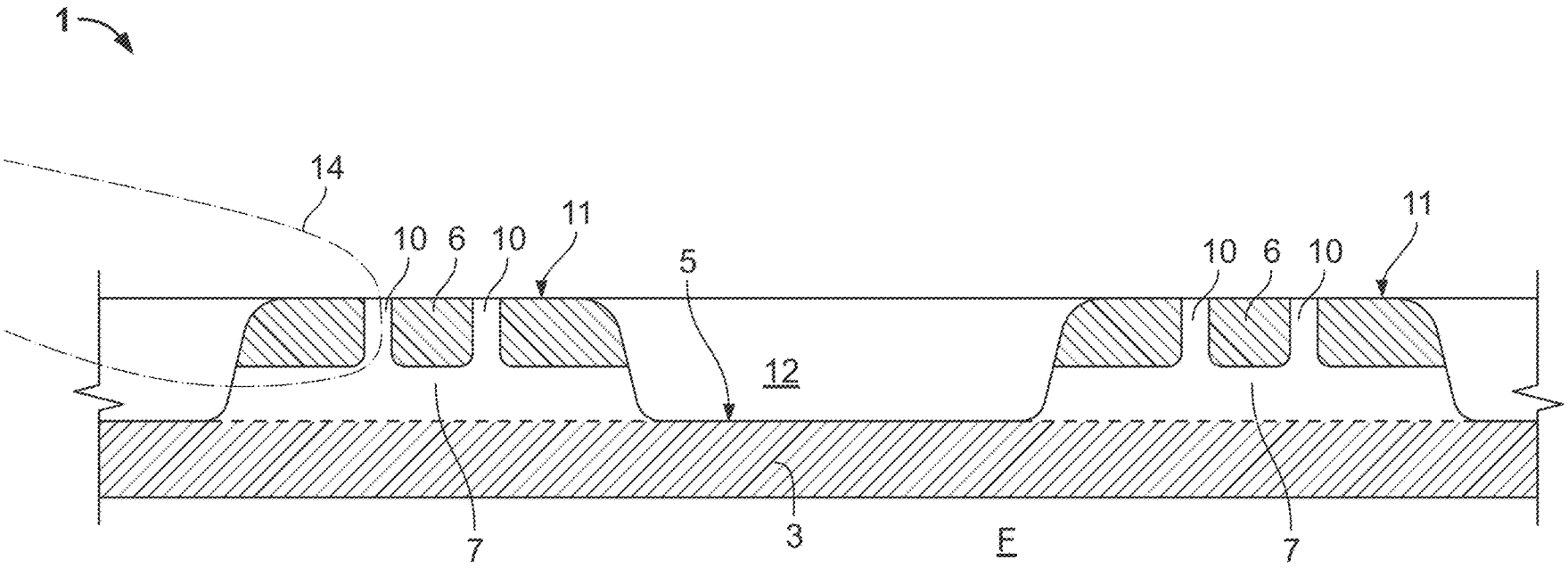
Figure 7:
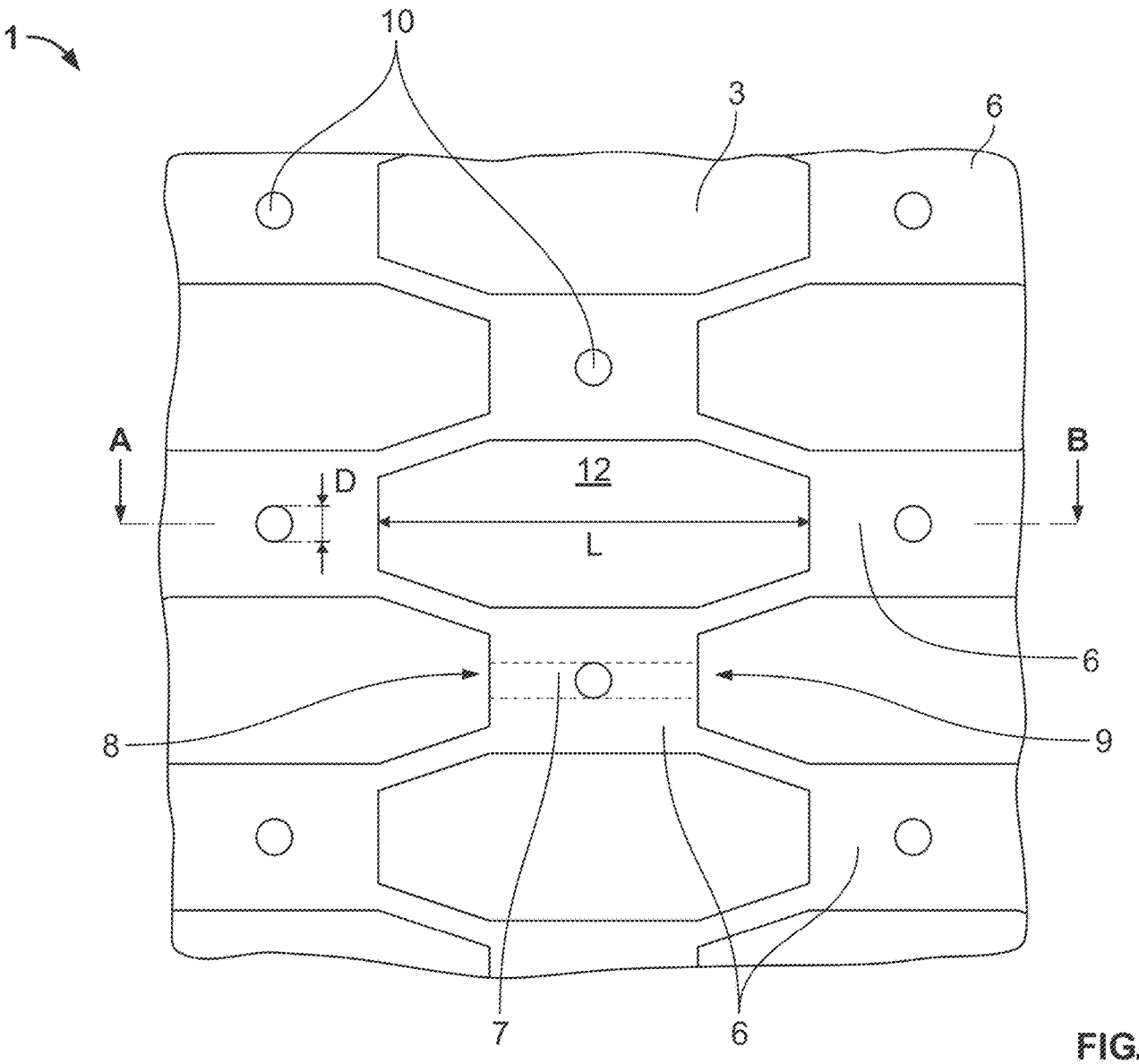

FIG. 3 shows again a part of the detail "X" according to a first embodiment of the invention, FIG. 4 shows a part of the detail "X" according to a second embodiment of the invention, FIG. 5 shows the cross section along the section A-B according to FIG. 2 for the first embodiment of the invention, FIG. 6 shows the cross section along the section A-B according to FIG. 2 for the second embodiment of the invention, FIG. 7 shows the detail "X" according to FIG. 1 for another embodiment of the invention.

In FIG. 1 a shoe 2 is depicted which has a shoe upper 1. In the shown embodiment the shoe upper is basically made by a knitting process. The upper 1 covers the foot F of the wearer of the shoe 2, thus it has an inner surface which is facing the foot F of the wearer and an outer surface which faces away from the foot F of the wearer.

Figure 3:
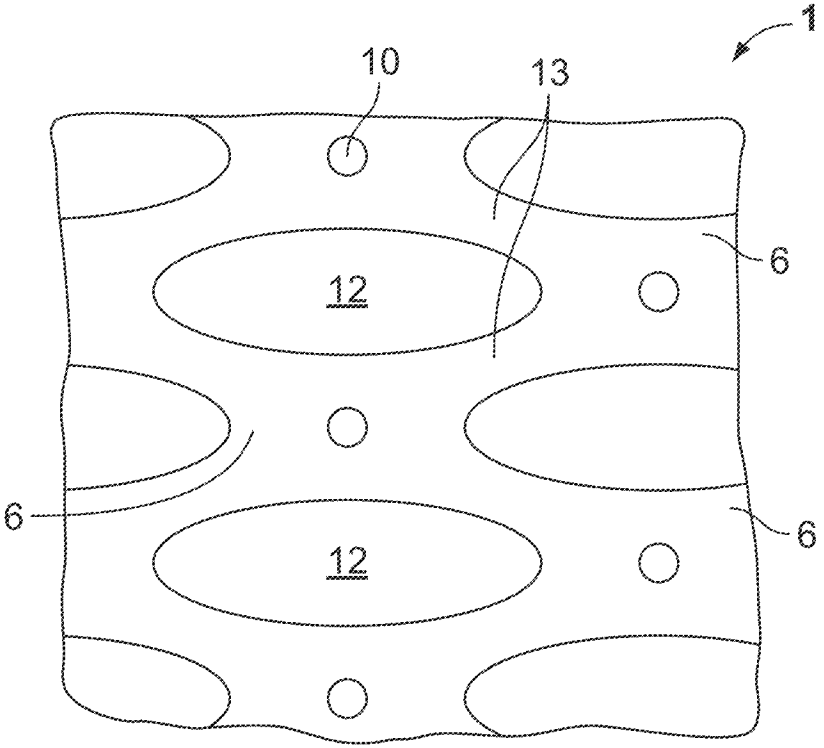

FIGS. 2, 3 and 5 show details of a first embodiment of the shoe upper 1. FIGS. 4 and 6 show a second embodiment of the shoe upper 1. Finally, FIG. 7 shows a further, third embodiment of the shoe upper 1.

The reference numerals are always the same in all embodiments. So, the following explanation applies basically for all depicted embodiments.

As can be seen from FIGS. 2, 3 and 5 the shoe upper 1 has a base layer 3 on which a structured layer 4 is arranged. The base layer 3 faces with one (inner) side the foot F of the wearer and faces with one (outer) side away from the same. The base layer has an outer surface 5. At the outer surface 5 of the base layer 3 the structured layer 4 is arranged.

The structured layer 4 has a plurality of tunnel sections 6. Each tunnel section 6 has a tunnel 7 (see FIG. 5) which extends from a first side 8 to a second side 9 of the tunnel section 6. Furthermore, the tunnel section 6 comprises one connecting channel 10 which connects the tunnel 7 with the outer surface 11 of the tunnel section 6.

Preferably, the length of the tunnel sections 6 and thus of the tunnels 7 which extend along the tunnel section 6 is between 1.0 cm and 2.0 cm. The connecting channels 10 are arranged preferably in the middle of the extension of the tunnel section 6 as long as only one connecting channel 10 is provided in a tunnel section 6.

If two connecting channels 10 are provided for each tunnel section 6 the location of each connecting channel 10 is preferably distanced from the first or second side 8, 9 of the tunnel section which a distance between 20% and 40% of the total length of the tunnel section 7.

Consequently, a path for a lace 14 is given along which the lace 14 can be threaded into the tunnel section 6. As a plurality of tunnel sections 6 is available the wearer of the shoe can select individual tunnels 7 for threading the lace 14.

Furthermore, it can be seen that always four tunnel sections 6 are connected via ridges 13 so that a homogeneous structure is obtained (as can be seen from FIG. 2). Four tunnel sections 6 enclose together with the ridges 13 areas 12 in which the base layer 3 is uncovered by tunnel sections 6 and ridges 13. The maximum length of those areas 12 is denoted with L. A value for L between 2.0 and 3.0 cm is preferred.

In FIG. 5 also the thickness t of the base layer 3 and the thickness T of the tunnel section 6 is denoted. Normally, the thickness t of the base layer 3 is between 1.0 and 2.0 mm. The thickness T of the tunnel section 6 is preferably bigger and has preferably a value between 2.0 and 3.0 mm.

In FIGS. 4 and 6 and alternative design is depicted which differs basically only in the fact that here two adjacent connecting channels 10 are provided side-by-side.

The diameter D of the connecting channels is denoted in FIG. 7 and is preferably between 1.0 and 3.0 mm.

As can be seen from FIG. 5 the lower side (adjacent to the base layer 3) of the tunnel 7 can be formed from the material of the tunnel section 6. As an alternative it is also possible (see FIG. 6) that the lower side of the tunnel 7 is directly formed by the material of the base layer 3.

Preferably two different yarns are used to knit the base layer 3 at the one hand side and the tunnel sections 6 including ridges 13 at the other hand. In spite of that a unitary knit structure is preferred which include both mentioned layers and sections.

In FIG. 7 a further embodiments of the invention is depicted. In distinction to the above explained embodiments (which have areas 12 with a substantially oval shape) the areas 12 of the solution according to FIG. 7 have an elongated octagonal shape. The cross section A-B as denoted in FIG. 7 is again shown in FIG. 5.

The area 12 can remain completely free but can alternatively be also provided with an additional structure or pattern, specifically to influence the visual appearance of the shoe.

Of course, it is possible to combine the features of the three explained embodiments. Thus for example the arrangement according to FIG. 7 can also be provided with two (or more) connecting channels 10.

The production of the described shoe upper can be carried out in an economical manner by means of a knitting machine, wherein a flat knitting process is preferred.

The used yarns can have different colors to support a pleasant appearance of the shoe upper.

REFERENCE NUMERALS

1 Shoe upper
2 Shoe
3 Base layer
4 Structured layer
5 Outer surface of the base layer
6 Tunnel sections
7 Tunnel
8 First side of the tunnel section
9 Second side of the tunnel section
10 Connecting channel
11 Outer surface of the tunnel section
12 Enclosed area
13 Ridge
14 Lace
L Maximum length of the area
t Thickness of the base layer
T Thickness of the tunnel section
D Diameter of the connecting channel
F Foot of the wearer

The invention claimed is:

1. A shoe upper for a shoe, the shoe upper comprising:

a plane base layer of material that is configured to extend parallel to a surface area of a foot of a wearer of the shoe; and a structured layer being arranged on an outer surface of the base layer, the structured layer being configured to face in an outward direction that extends away from the surface area of the foot of the wearer of the shoe and away from the base layer toward a surrounding environment, wherein the structured layer comprises a plurality of tunnel sections, wherein each tunnel section has at least one tunnel which extends in a direction that is parallel with the base layer of material from a first side to a second side of the tunnel section and wherein the tunnel section comprises at least one connecting channel which extends in the outward direction from the tunnel and connects the tunnel with an outer surface of the tunnel section, wherein the at least one connecting channel includes an open outer end that terminates at the outer surface of the tunnel section, wherein the base layer and the tunnel sections are made by a knitting process, and wherein the base layer and the tunnel sections form a unitary knit structure, and wherein the connecting channel is distanced from the first side and the second side of the tunnel section.

2. The shoe upper according to claim 1, wherein exactly one connecting channel is arranged in each tunnel section.

3. The shoe upper according to claim 1, wherein two connecting channels are arranged side-by-side in each tunnel section.

4. The shoe upper according to claim 1, wherein four adjacent tunnel sections enclose an area in which the base layer is free from covering tunnel sections.

5. The shoe upper according to claim 4, wherein the area has an elongated shape.

6. The shoe upper according to claim 5, wherein the area has an elliptical shape.

7. The shoe upper according to claim 5, wherein the area has a polygonal shape.

8. The shoe upper according to claim 4, wherein the area-has a maximum length (L) between 5.0 mm and 40.0 mm.

9. The shoe upper according to claim 1, wherein two adjacent tunnel sections are connected with another by a ridge, wherein the ridge has substantially the same thickness as the tunnel sections.

10. The shoe upper according to claim 1, wherein the base layer has a thickness (t) between 0.5 and 4.0 mm.

11. The shoe upper according to claim 1, wherein the tunnel section has a thickness (T) between 1.0 and 4.0 mm.

12. The shoe upper according to claim 1, wherein the at least one connecting channel has a diameter (D) between 1.0 and 3.0 mm.

13. The shoe upper according to claim 1, wherein the base layer is made from a first yarn and the tunnel sections are made from an at least one second yarn, wherein the at least one second yarn is different from the first yarn.

14. The shoe upper according to claim 1, wherein the at least one connecting channel is configured to receive a lace through the open outer end.

15. The shoe upper according to claim 1, wherein the at least one connecting channel includes an internal end that is opposite the open outer end, wherein the at least one connecting channel defines a first direction that extends between the internal end and the open outer end, and wherein the first direction extends in a transverse direction from the base layer of material.

16. The shoe upper according to claim 15, wherein the internal end is proximate to the plane base layer, wherein the open outer end is disposed distal to the plane base layer, and wherein the at least one connecting channel includes a sidewall that extends between the internal end and the open outer end.

17. The shoe upper according to claim 1, wherein the base layer includes an inner side and the outer surface, and wherein the outward direction extends from the inner side of the base layer toward the structured layer.

* * * * *